US008132523B2

(12) United States Patent
White, Jr.

(10) Patent No.: US 8,132,523 B2
(45) Date of Patent: Mar. 13, 2012

(54) PORTABLE, SINGLE-PERSON PONTOON BOAT, KIT AND METHOD

(76) Inventor: Felix White, Jr., Gary, IN (US)

( * ) Notice: Subject to any disclaimer, the term of this patent is extended or adjusted under 35 U.S.C. 154(b) by 369 days.

(21) Appl. No.: 12/385,077

(22) Filed: Mar. 30, 2009

(65) Prior Publication Data

US 2009/0183664 A1 Jul. 23, 2009

Related U.S. Application Data

(63) Continuation-in-part of application No. 11/985,787, filed on Nov. 16, 2007, now abandoned.

(60) Provisional application No. 60/860,368, filed on Nov. 21, 2006.

(51) Int. Cl.

| | |
|---|---|
| ***B63B 1/10*** | (2006.01) |
| ***B63B 1/12*** | (2006.01) |
| ***B63B 7/02*** | (2006.01) |
| ***B63B 17/00*** | (2006.01) |

(52) U.S. Cl. ..... 114/61.1; 114/61.22; 114/61.24; 114/352

(58) Field of Classification Search ..... 114/61.1, 114/61.15–61.19, 61.22–61.25, 352–354
See application file for complete search history.

(56) References Cited

U.S. PATENT DOCUMENTS

| | | | | |
|---|---|---|---|---|
| 1,794,417 | A | 3/1931 | Nador | |
| 4,698,034 | A * | 10/1987 | Anthonijsz | 440/27 |
| 4,836,298 | A * | 6/1989 | Laboureau | 114/61.2 |
| 5,042,411 | A * | 8/1991 | Krolczyk | 114/39.26 |
| D390,528 | S * | 2/1998 | Roberson | D12/304 |
| 6,345,582 | B1 * | 2/2002 | Dudink | 114/61.15 |
| 6,397,769 | B1 * | 6/2002 | Bullmer | 114/61.1 |

FOREIGN PATENT DOCUMENTS

| | | | |
|---|---|---|---|
| FR | 2749269 | A1 | 12/1997 |
| WO | WO 8808804 | A1 * | 11/1988 |

* cited by examiner

*Primary Examiner* — Ajay Vasudeva
(74) *Attorney, Agent, or Firm* — Richard C. Litman

(57) ABSTRACT

The portable, single-person pontoon boat includes a hull having a deck and at least one sidewall. The hull defines an open interior region. At least one laterally extending, elongated frame member having opposed first and second hollow ends is fixed to the bottom of the hull. First and second pontoon floats are further provided, along with at least one pair of spars. A distal end of each of the spars is releasably secured to a respective one of the first and second pontoon floats. A proximal end of each of the spars is slidably received within a respective one of the first and second ends of the at least one laterally extending, elongated frame member and releasably fastened thereto.

9 Claims, 7 Drawing Sheets

PORTABLE, SINGLE-PERSON PONTOON BOAT, KIT AND METHOD

CROSS-REFERENCE TO RELATED APPLICATION

This application is a continuation-in-part application of U.S. patent application Ser. No. 11/985,787, filed on Nov. 16, 2007 now abandoned, which claimed the benefit of U.S. Provisional Patent Application Ser. No. 60/860,368, filed on Nov. 21, 2006.

BACKGROUND OF THE INVENTION

1. Field of the Invention

The present invention relates to pontoon boats, particularly to small and easily transportable pontoon boats for single-person use, along with a kit for assembling pontoon boats and a method of use.

2. Description of the Related Art

Small pontoon boats or watercraft typically include a pair of pontoon floats that are interconnected to, and support, a deck member. The user or users typically sit or are otherwise positioned on the deck member when the boat is floating on a body of water, such as a stream, river, lake or the like.

In a typical pontoon boat, the pair of pontoon floats are often elongated, buoyant structures that are positioned in a generally fore-to-aft orientation, parallel to one another. The pontoon floats are typically disposed at least partially outboard of the deck member. Such pontoon floats generally provide greater on-water stability than is typically possible in a comparably sized, single-hulled small watercraft.

The relatively high on-water stability of such a pontoon boat design makes it an attractive choice for small transport boats, such as those used for fishing. The disadvantage of such a pontoon boat design, particularly when adopted for small fishing boats and the like, is the difficulty typically encountered in its off-water handling and transport. These handling and transport difficulties are particularly inconvenient with regard to small fishing boats, since the user typically must not only haul the boat out of the water, but also transport the boat to a remote storage site after every use, and then follow the reverse procedure of transporting and launching for the next usage.

Design modifications for improving off-water transportability and ease of storage of small pontoon boats often sacrifice one or more of the one-water stability, integrity and safety features of the basic design. Such trade-offs can lead to dangerous on-water risks, particularly for the user of a single-person fishing boat who does not have access to sophisticated safety equipment or at-hand assistance in emergency situations. It would be desirable to provide a portable, single-person pontoon boat that not only has improved off-water transportability and ease of storage, but also has improved on-water stability, integrity and safety features.

Thus, a portable, single-person pontoon boat, kit and method solving the aforementioned problems is desired.

SUMMARY OF THE INVENTION

The portable, single-person pontoon boat includes a hull having a flat bottom or deck and at least one sidewall. The hull defines an open interior region. At least one laterally extending, elongated arm or frame member having opposed first and second hollow ends is fastened or affixed to the bottom of the hull, the hollow ends extending to opposite sides of the hull.

First and second pontoon floats are further provided, along with at least one set of first and second spars or connection members. The distal end of each of the first and second spars is releasably attached to a respective one of the first and second pontoon floats. The proximal end of each of the first and second spars is slidable into the hollow first and second ends of the at least one laterally extending, elongated frame member, where it is secured by a hitch pin or the like extending through the spar and the frame member.

Preferably, at least one base plate is secured to an upper surface of each of the first and second pontoon floats, with each of the at least one base plates having a substantially U-shaped channel formed therein for receiving a respective distal end of one of the first and second spars, which is releasable fastened thereto.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
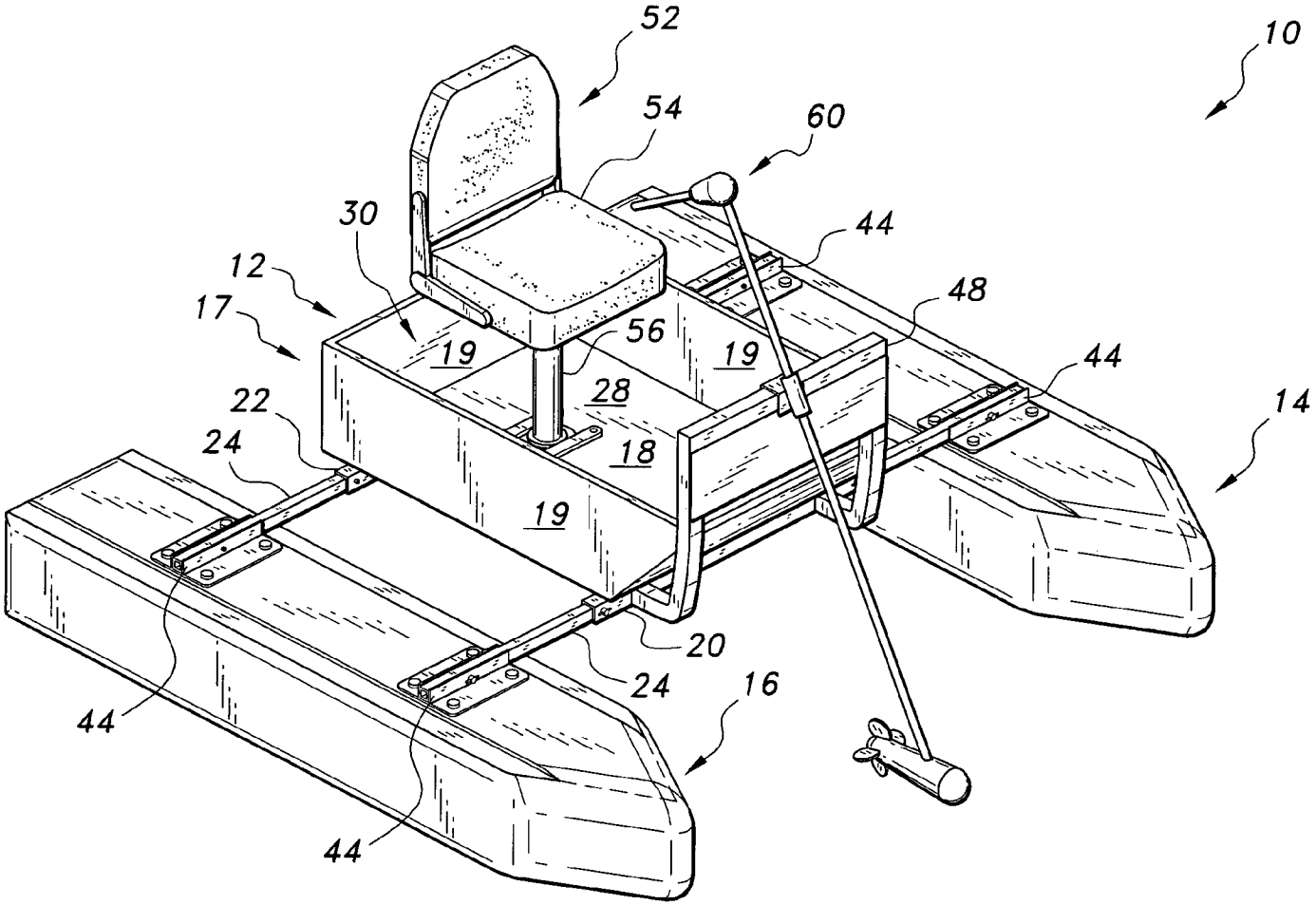
FIG. 1 is a perspective view of a portable, single-person pontoon boat according to the present invention.

Now referring to FIG. 1, the portable, single-person pontoon boat, generally indicated as 10 in the drawings, includes a rigid hub assembly 12, and a pair of pontoon floats 14, 16. First and second pontoon floats 14, 16 are respectively oriented on the port and starboard sides of rigid hub assembly 12. As shown, pontoon floats 14, 16 are disposed on opposed sides of rigid hub assembly 12. Pontoon floats 14, 16 support the rigid hub assembly 12 when the pontoon boat 10 is placed in water.

Figure 3:
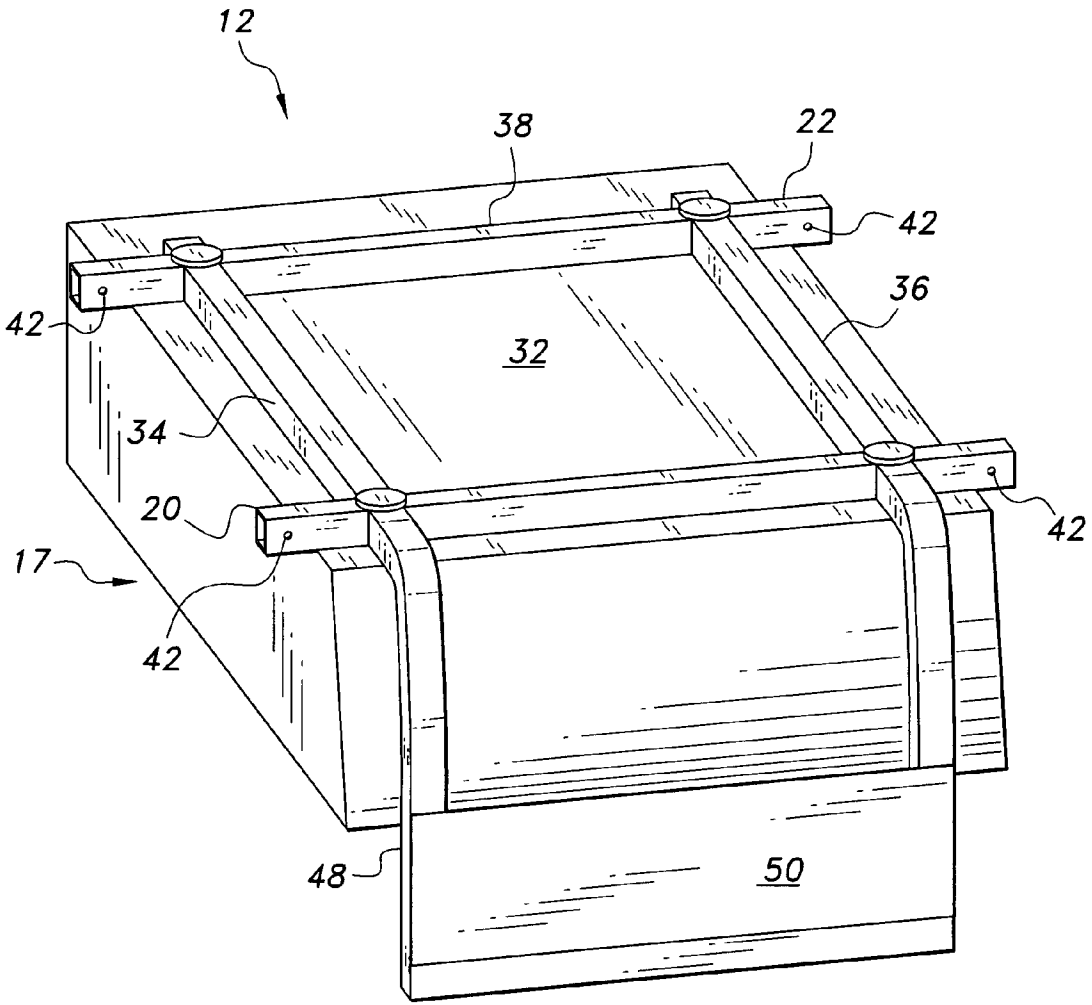
FIG. 3 is a bottom perspective view of a hub assembly of the portable, single-person pontoon boat of FIG. 1.
Figure 5:
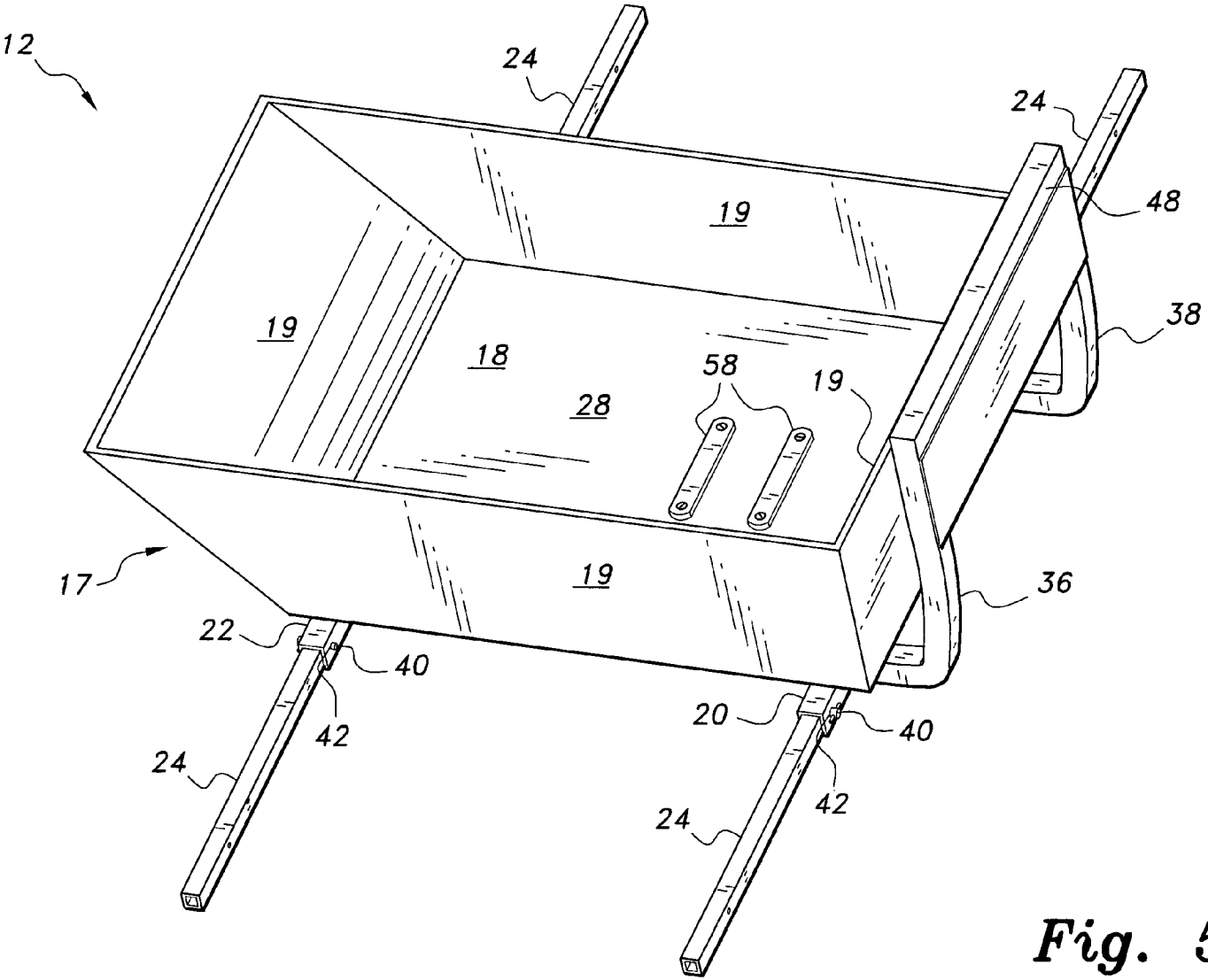
FIG. 5 is a perspective view of the hub assembly of the portable, single-person pontoon boat of FIG. 1, illustrating a plurality of spars mated to rigid frame members.

As best shown in FIGS. 3 and 5, the rigid hub assembly 12 includes a hull 17 having a flat bottom or deck 18. A pair of rigid arm or frame members 20, 22 are fixed to the lower surface 32 of the flat bottom 18, and are arranged parallel to one another, with each rigid frame member 20, 22 extending along the lateral direction, and with each rigid frame member 20, 22 further being attached to flat bottom 18 adjacent a respective longitudinal end thereof. In FIG. 1, only the starboard ends of rigid frame members 20, 22 are shown. It should be understood that rigid frame members 20, 22 are symmetric about the longitudinal axis and that port pontoon float 14 is indirectly attached to rigid frame members 20, 22 in the same manner as that illustrated with regard to starboard pontoon float 16.

Figure 6:
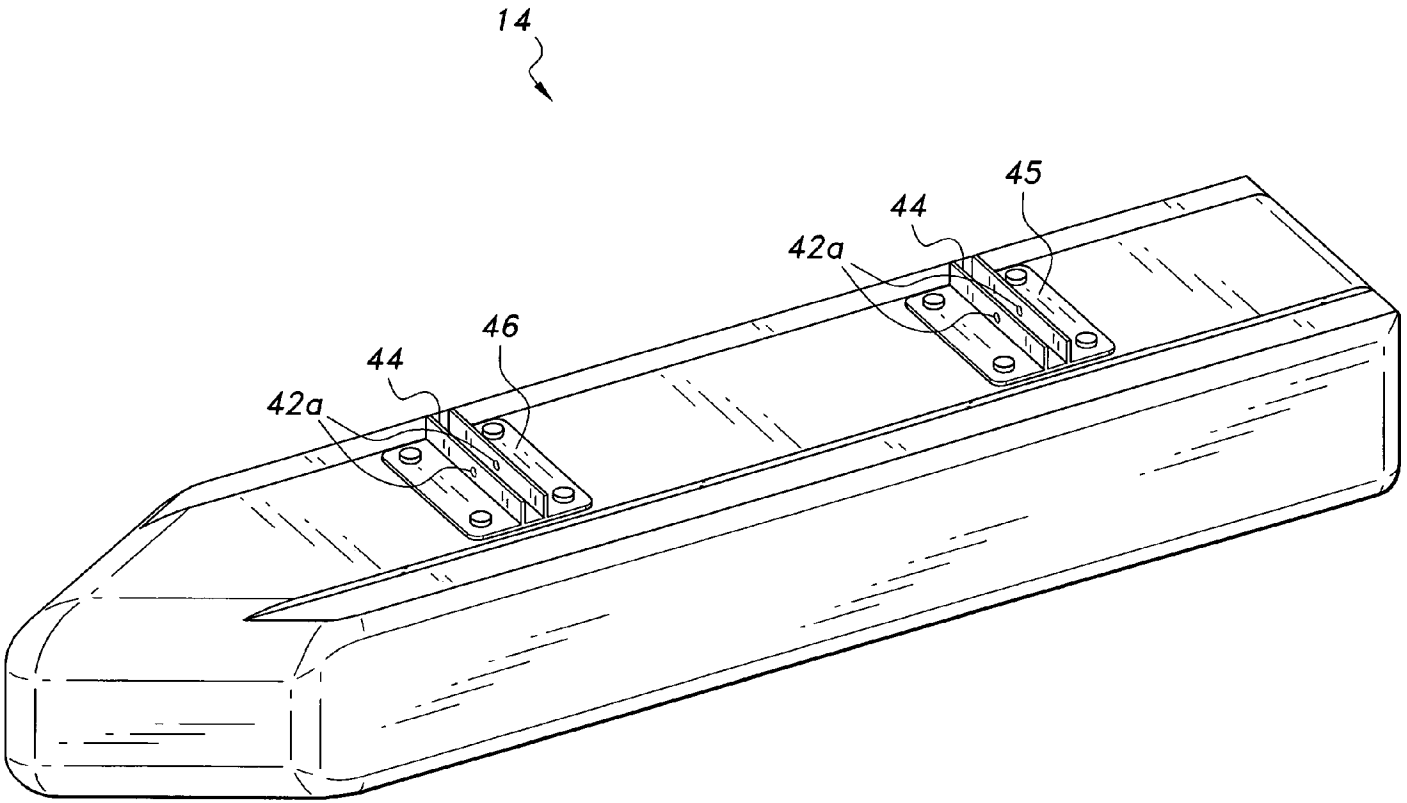
FIG. 6 is a perspective view of a pontoon float of the portable, single-person pontoon boat of FIG. 1.

As shown in FIG. 1, a pair of rigid connecting members or spars 24 are secured to the upper surfaces of each pontoon float 14, 16. Each spar 24 is detachably mounted at its first or inner end to the distal or free end of one of the rigid frame members 20, 22. The second, or outer, end of each spar 24 is secured to a respective connection site 45 (as shown in FIG. 6) on the upper or top surface of the respective pontoon float.

Figure 4:
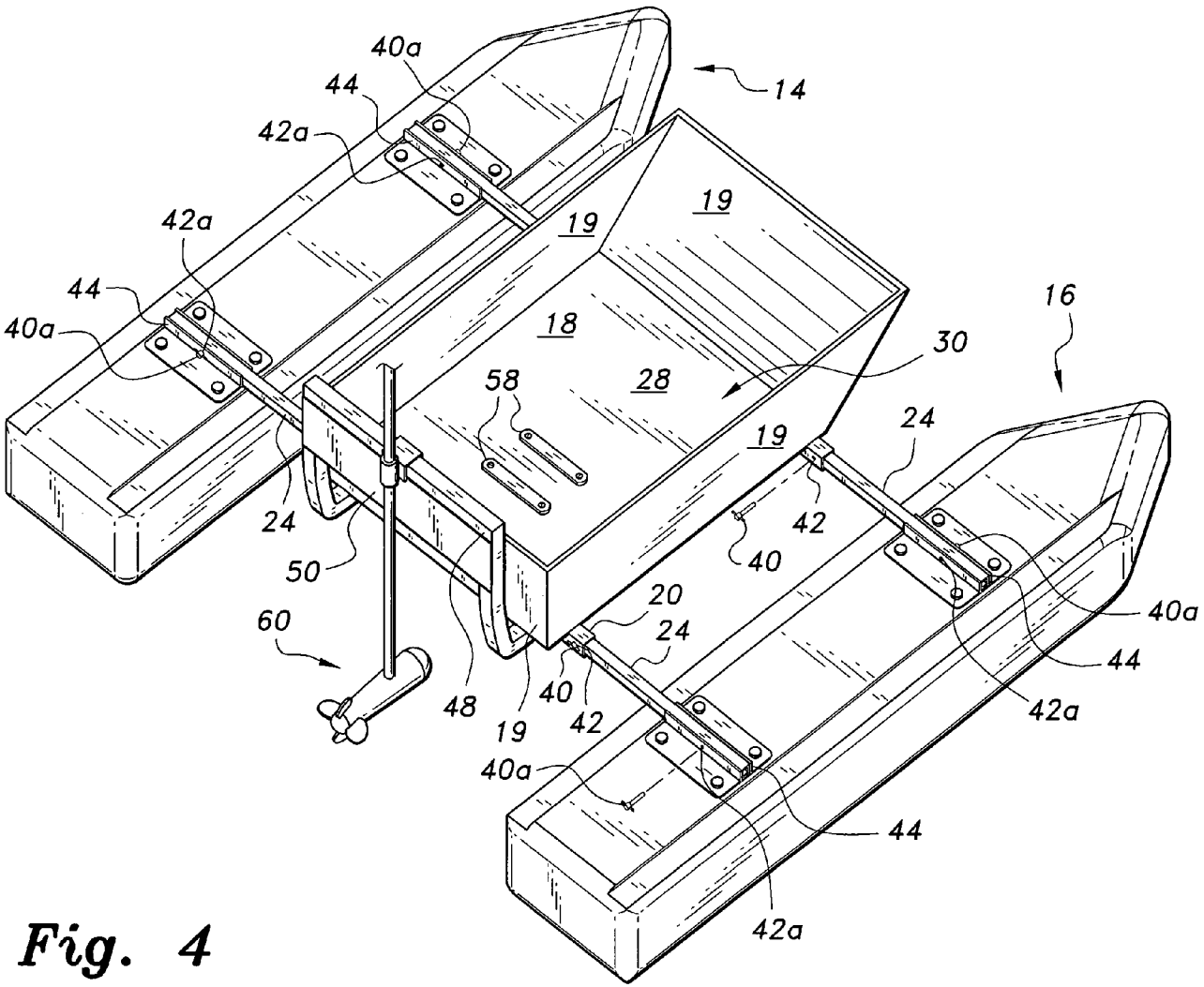
FIG. 4 is a rear perspective view of the portable, single-person pontoon boat according to the present invention.

As best shown in FIGS. 1 and 4, the hull 17 has an open upper end and defines a shallow cockpit 30 therein. The open interior region of cockpit 30 is adapted for receiving the single-person crewmember or boater during usage of pontoon boat 10. Unlike conventional "flat platform" watercraft, hull 17 includes a flat bottom 18 having sidewalls 19 secured thereto (defining the cockpit region 30), thus preventing intrusion of water within the cockpit region 30. The sidewalls 19 of hull 17, as shown in FIG. 1, are substantially upright, both at the stern, and along the port and starboard sides, but the bow sidewall (best shown in FIG. 4) is inclined along the forward direction. The exposed, upper surface 28 of flat bottom 18 is bordered and protected by the sidewalls 19 of hull 17.

Hub assembly 12 includes the hull 17, along with frame 26 (shown in FIG. 2), which is attached to the lower surface 32 of flat bottom 18. Frame 26 includes the pair of rigid arms or frame members 20, 22 that are fixed to the pair of fore-aft beams 34, 36, which extend orthogonal to rigid frame members 20, 22, as shown. Frame members 20, 22 and fore-aft beams 34, 36 form a rectangular frame core 38, which is dimensioned to mate against lower surface 32. As shown, and as noted above with regard to connection to pontoon floats 14, 16, the laterally opposed ends of frame members 20, 22 extend beyond the rectangular frame core 38 in the lateral direction.

Exemplary dimensions of the hull 17 include a lower surface 32 of flat bottom 18 having a length of approximately thirty-eight inches and a width of approximately twenty-four inches (resulting in a surface area of approximately 912 $in^2$ with a length/width ratio of approximately 1.6). For a lower surface 32 having these dimensions, the rectangular frame core 38 would preferably have outer dimensions of approximately 34.5 inches in length and approximately 18.5 inches in width. Thus, since the frame 26 is affixed squarely to the lower surface 32 of hull 17, the frame core 38 is set in approximately 2.75 inches from the peripheral edges of lower surface 32. This configuration, in which frame core 38 approaches, but stops short of, spanning the surface 32 provides for a high degree of both support and stability for the hull 17 of pontoon boat 10.

Using the exemplary dimensions given above, the extending port and starboard ends of frame members 20, 22 preferably extend from the lower surface 32 of flat bottom or deck 18 by approximately two to three inches. This distancing allows the free ends of frame members 20, 22 to be easily accessed and handled when securing and detaching the pair of pontoon floats 14, 16 thereto, as will be described in further detail below. These projecting regions further provide convenient handgrips for holding and/or controlling the hub assembly 12 when the pair of pontoon floats 14, 16 are detached from hub assembly 12.

Figure 2:
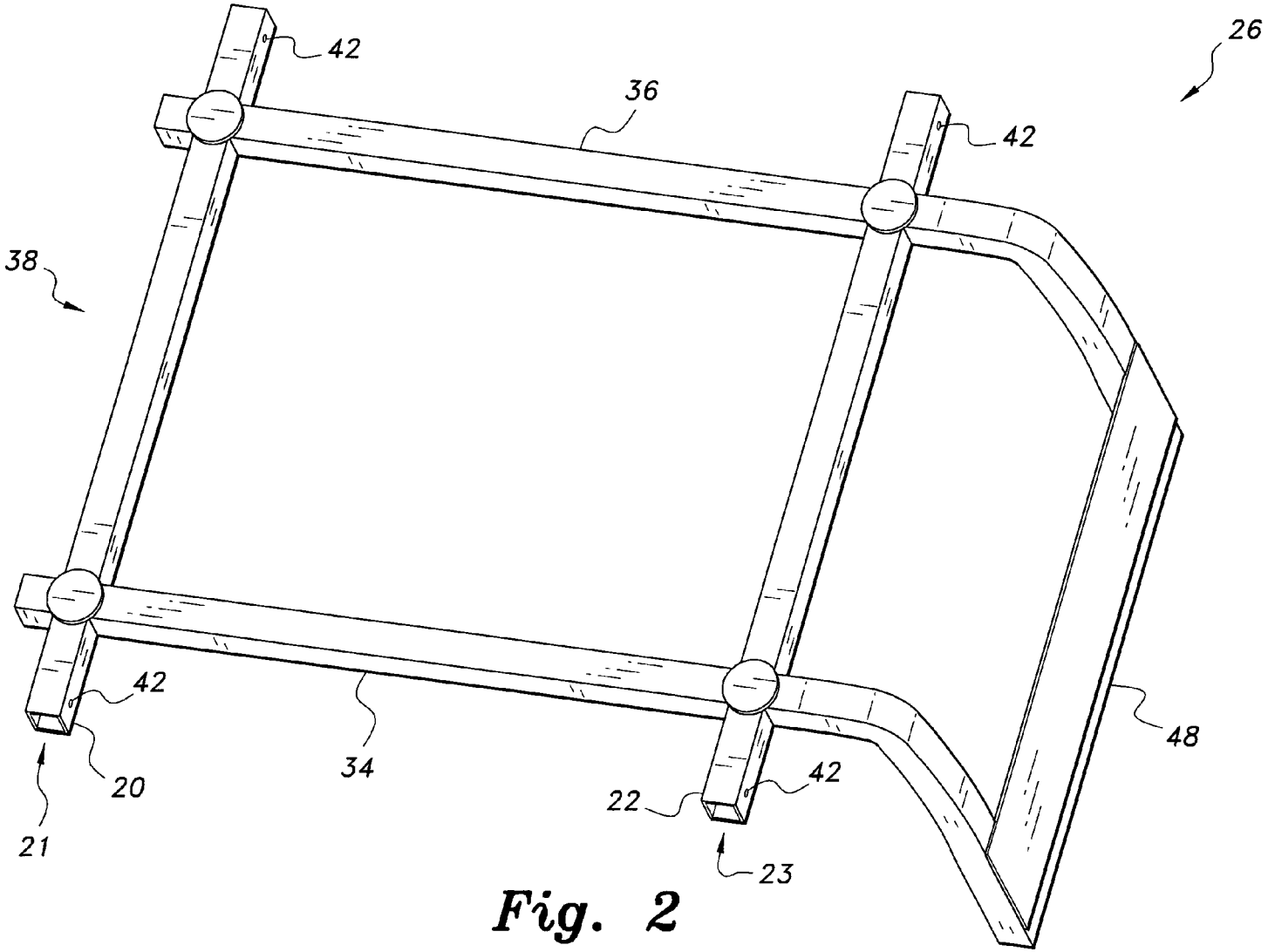
FIG. 2 is a bottom perspective view of a frame of the portable, single-person pontoon boat of FIG. 1.

With reference to FIGS. 5 and 6, when the pontoon floats 14, 16 are attached to hub assembly 12, the pair of pontoon floats 14, 16 are positioned in a parallel, spaced-apart relationship with respect to one another, flanking the hub assembly 12, and being affixed thereto via the spars 24. Corresponding to the exemplary dimensions given above, each spar 24 is approximately nineteen inches long, and is releasably fastened at one end to a corresponding free end of one of frame members 20, 22, and is fastened at the other end to one of the pontoon floats 14, 16. Each spar 24 slides within the corresponding hollow free end of frame members 20, 22, and is releasably secured therein by any suitable releasable attachment, such as a cotter pin 40, hitch pin, or the like. Pin 40, as shown, passes through apertures 42, formed through the free ends of frame members 20, 22 and mating apertures in the spars 24. The hollow ends 21, 23 of frame members 20, 22, respectively, are best shown in FIG. 2.

As best shown in FIGS. 4 and 6, the opposite end of each spar 24 is received within a corresponding U-shaped channel 44 formed by parallel L-shaped plates 46, 45. Each plate 46, 45 is mounted to a respective upper surface of one of pontoon floats 14, 16. Each spar 24 is releasably secured within the corresponding channel 44 by a horizontal hitch pin, cotter pin **40*a* or the like, which passes horizontally through corresponding apertures 42*a*, formed through the sides of each channel 44, and mating apertures formed through each spar 24**.

As shown, a pair of plates 46 are secured to the upper surface of each pontoon float 14, 16 so that when the pontoon boat 10 is in a fully assembled state, each spar 24 is fastened to a corresponding U-shaped channel 44, and is also fastened to one of the free ends of rigid frame members 20, 22, thus securing floats 14, 16, in a flanking orientation to the hub assembly 12.

Pontoon floats 14, 16 are the positively buoyant components of the pontoon boat 10, and their positive buoyancy is sufficient to impart overall positive buoyancy to the pontoon boat 10. The pontoon boat 10 will not only float when placed in a body of water, but will also float if turned upside down. The characteristic of floating upside down is augmented and enhanced by the placement of the pair of pontoon floats 14, 16, namely with the topside of each of the pontoon floats 14, 16 being not only substantially coplanar with respect to one another, but also being substantially coplanar with the lower surface 32 of flat bottom 18 of hull 17.

Preferably, the various framing and support components of the pontoon boat 10 are formed from commercially-available, flat, squared and square-tubed aluminum stock pieces, i.e., square tubing. Using the exemplary dimensions given above, the four spars 24 are each preferably approximately ⅛ of an inch thick, approximately 1.5 inches square in cross-section (made from square tubing), and approximately nineteen inches long. Each frame member 20, 22 is preferably approximately 1.75 inches square in cross-section (made from square tubing) and approximately twenty-eight inches long. Each fore-aft beam 34, 36 is preferably approximately ⅛ of an inch thick, approximately 1½inches wide, and approximately six feet long. Each U-shaped channel 44 is preferably approximately 9½ inches long and approximately 1.75 inches wide. As noted above, each U-shaped channel 44 is formed by a pair of base plates 46, 45, which are preferably approximately 9½ inches in length, approximately six inches in width, and approximately ⅛ of an inch thick. Each base plate 46, 45 is secured to an upper surface of one of pontoon floats 14, 16 by any suitable fastener, such as four ¼ inch rivets and two sheet metal screws. Each fore-aft beam 34, 36 is preferably welded to the sides of the arms 20, 22, at their intersection points, using ⅛ by four inch aluminum braces or the like to strengthen the intersection.

As shown in FIGS. 2 and 5, the fore-aft beams 34, 36 are each arcuately shaped at the bow end of the hull 17 so that the bow ends of beams 34, 36 are aligned substantially orthogonal to the opposed ends thereof. The bow ends are positioned in spaced-apart relationship and are secured to a pair of aft crossbeams 48 (preferably formed from similar aluminum square stock), with opposed ends of each crossbeam 48 preferably being welded to the bow ends of the fore-aft beams 34, 36. As shown in FIG. 4, the pair of fore-aft beams 34, 36 and the pair of crossbeams 48 define an upright motor mount 50 (also referred to as a "gun-whale" or "gunnel") for attachment to a conventional trolling motor, such as the exemplary trolling motor 60 shown in FIGS. 1 and 4.

Figure 7:
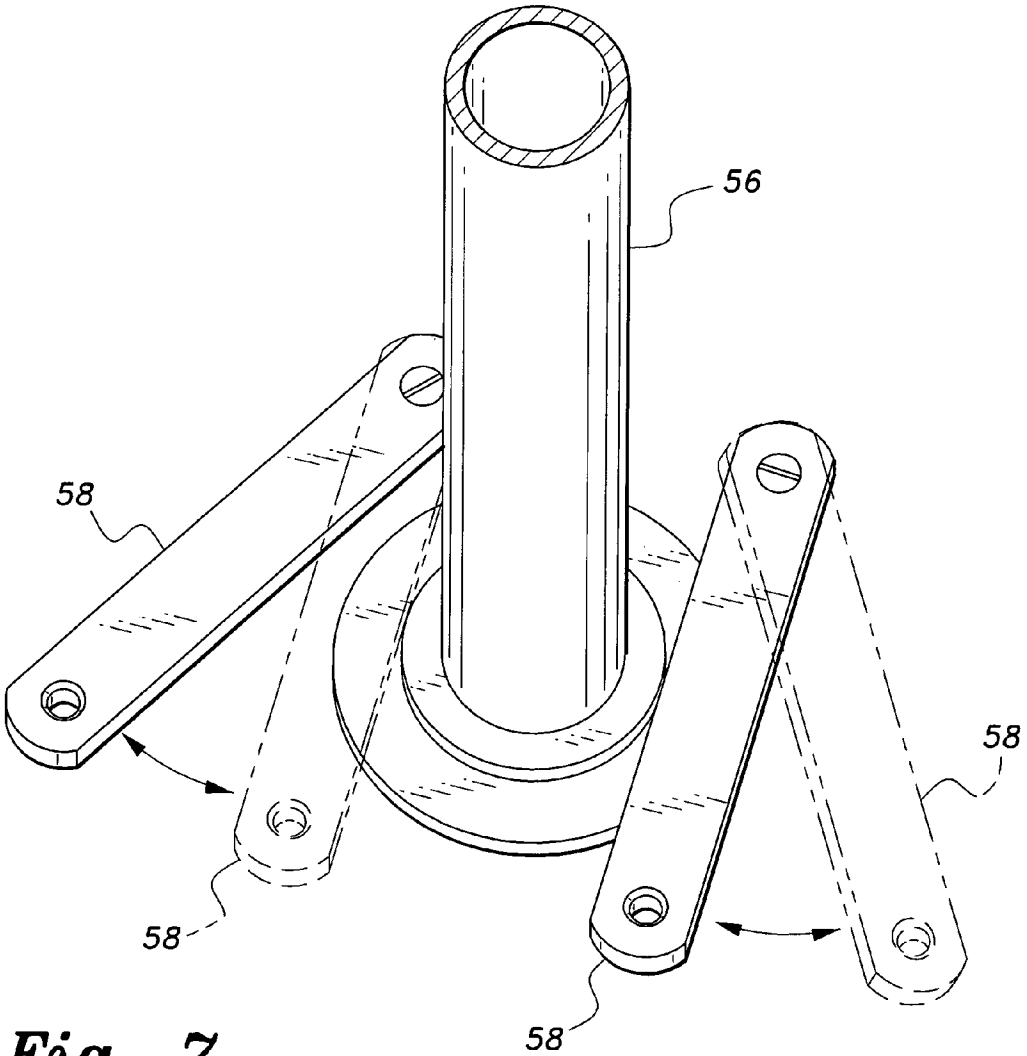
FIG. 7 is a partial perspective view of a mechanical mounting of a swivel chair of the portable, single-person pontoon boat of FIG. 1.

A swivel chair 52, having a seat 54 and an upright swivel stand 56 (which may have a height of approximately fourteen inches), is attached to deck 18 by a pair of conventional pedestal quick-release clamps 58 (shown in FIGS. 4 and 7). The swivel chair 52 is mounted on the deck 18 when the pontoon boat 10 is assembled for use, and may be detached from the deck 18 when the pontoon boat 10 is disassembled for transport or storage.

Each of pontoon floats 14, 16 is preferably tapered, as shown, and has an exemplary length of approximately six feet and ten inches. As shown, each pontoon float 14, 16 preferably has a maximal width (measured along the lateral direction) towards the aft of approximately eighteen inches, which tapers down to approximately fourteen inches at a point which is approximately two feet aft of the forward-most point of the pontoon float. From this point, the pontoon float further tapers down, towards the bow, to a width of approximately two inches at the forward-most point. Each pontoon float 14, 16 is approximately ten inches thick. Base plates 46, 45 are positioned on each pontoon float 14, 16 so that the central point between each pair of plates 46, 45 is aligned with the center of the hub assembly 12.

The centering of hub assembly 12 with respect to the central points of pontoon floats 14, 16, along with the positioning of frame core 38 centered with respect to the lower surface 32 of the deck 18, not only provide stability to the pontoon boat 10 when floating in water, but further permit the hub assembly 12 to be reversed with respect to pontoon floats 14, 16. In FIG. 4, the hub assembly 12 is shown attached to pontoon floats 14, 16 in an orientation reverse of that shown in FIG. 1, with the motor mount 50 being positioned at the stern of boat 10. The swivel chair 52 is releasably mounted to deck 18 by clamps 58, and may be detached and reversed in position for use with the orientation of FIG. 4.

Preferably, each of pontoon floats 14, 16 is foam-filled and has an internal spine (designated as 16*a* in FIG. 4 and shown in phantom) having a length of approximately six feet and ten inches, with a width of approximately ½ an inch. The spine 16*a* is a reinforcing support positioned at the top of the foam, which may be wrapped in a fiberglass outer layer sprayed with a resin.

Hull 17 may be formed as an aluminum shell having a thickness of approximately 1/16 of an inch with a plywood bottom, although it should be understood that hull 17 may be formed from any suitable water-impermeable material. Hull 17 is preferably secured to frame 26 by four ¼ by three-inch bolts and nuts, or by any other suitable types of fasteners. Cockpit 30 is preferably approximately seven inches deep, and sidewalls 19 of hull 17 may have an inwardly facing upper lip, extending approximately one inch inward.

Given the above exemplary dimensions and materials, the pontoon boat 10 can support a person or load of up to approximately two hundred fifty pounds without sinking. The pontoon boat 10 is easily disassembled for storage and transport, with hub assembly 12 having dimensions of approximately two feet by four feet by less than one foot, and with each pontoon float 14, 16 having dimensions of approximately 1½ by 6.8 by 1½ feet. The remaining components may be stored within the cockpit 30 of hull 17 for transport and storage. The pontoon boat 10, in the disassembled state, can easily be lifted in and out of, and transported in, a van or mini-van, a pickup truck, or the like, and can easily be stored in a basement, a garage, or a walk-in closet.

In use, the rigid hub assembly 12 and the pontoon floats 14, 16 are transported to a location proximate the intended launch site. Next, the port pontoon float 14 and the starboard pontoon float 16 are separately mounted to the hub assembly 12 via interconnection between connection members 24, the U-shaped channels 44 of the pontoon floats 14, 16, and the free ends of the arms 20, 22. The swivel chair may then be mounted on deck 18 via clamps 58, and the pontoon boat 10 may be launched in the water. After use, the pontoon floats 14, 16 and the swivel chair may be detached for transport and storage.

The boat 10 may also be provided to the user in the form of a kit, with the kit including the rigid hub assembly 12, including the hull 17, the port and starboard pontoon floats 14, 16, and the spars 24. Assembly of the kit is as described above with regard to the pontoon boat 10.

It is to be understood that the present invention is not limited to the embodiments described above, but encompasses any and all embodiments within the scope of the following claims.

I claim:

1. A portable, single-person pontoon boat, comprising:

a hull having a flat bottom and at least one sidewall, the hull defining an open interior region;

at least one laterally extending, elongated frame member having opposed first and second ends extending to opposite sides of the hull, each of the ends being hollow, the at least one frame member being fixed to the bottom of the hull;

first and second pontoon floats disposed on opposite sides of the hull, further comprising a pair of channels attached to each said pontoon float; and at least one pair of spars, each of the spars having a proximal end and a distal end, the distal end being slidably received in and releasably fastened to a respective one of the channels, wherein the channels and spars each has an aligned horizontal passage defined therein, further comprising a horizontal pin extending through the aligned horizontal passages in each of the spars and the channels to releasably fasten each said spar to the corresponding channel in order to secure said pontoon floats to said spars, and further wherein the proximal ends being slidable into the hollow ends of the at least one frame member and releasably fastened thereto.

2. The portable, single-person pontoon boat as recited in claim 1, further comprising a pin releasably fastening the proximal ends of each said spar to the ends of said frame member.

3. The portable, single-person pontoon boat as recited in claim 1, wherein the at least one frame member comprises a pair of frame members spaced apart longitudinally at opposed ends of said hull.

4. The portable, single-person pontoon boat as recited in claim 3, further comprising a pair of spaced apart, longitudinally extending beams connecting said laterally extending frame members.

5. The portable, single-person pontoon boat as recited in claim 4, wherein each of said longitudinally extending beams has opposed first and second ends, each of the first ends being arcuate.

6. The portable, single-person pontoon boat as recited in claim 5, further comprising at least one crossbeam extending between the first ends of said pair of spaced apart longitudinally extending beams, the crossbeam and said pair of longitudinally extending beams defining a motor mount.

7. The portable, single-person pontoon boat as recited in claim 5, wherein said pair of spaced apart, longitudinally extending beams and said pair of laterally extending frame members define a rectangular frame having a center, the center of the rectangular frame being aligned with longitudinal centers of said first and second pontoon floats.

8. The portable, single-person pontoon boat as recited in claim 1, further comprising a chair releasably mounted within the open, interior region of said hull.

9. The portable, single-person pontoon boat as recited in claim 1, wherein said spars and said frame members are made from square tubing.

* * * * *